US008899053B2

(12) United States Patent
Matsubara

(10) Patent No.: US 8,899,053 B2
(45) Date of Patent: Dec. 2, 2014

(54) CRYOGENIC REFRIGERATOR

(71) Applicant: Takahiro Matsubara, Tokyo (JP)

(72) Inventor: Takahiro Matsubara, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 301 days.

(21) Appl. No.: 13/649,328

(22) Filed: Oct. 11, 2012

(65) Prior Publication Data

US 2013/0031916 A1 Feb. 7, 2013

Related U.S. Application Data

(63) Continuation of application No. PCT/JP2011/059052, filed on Apr. 12, 2011.

(30) Foreign Application Priority Data

Apr. 14, 2010 (JP) ..... 2010-093281

(51) Int. Cl.
*F25B 9/00* (2006.01)
*F25B 9/14* (2006.01)

(52) U.S. Cl.
CPC ..... *F25B 9/14* (2013.01); *F25B 2309/001* (2013.01)
USPC ..... 62/6

(58) Field of Classification Search
CPC ..... F25B 9/14; F25B 15/004; F25B 9/145; F25B 3/08; F25B 2309/001
USPC ..... 62/6; 251/304
See application file for complete search history.

(56) References Cited

U.S. PATENT DOCUMENTS

| | | | | |
|---|---|---|---|---|
| 4,391,103 | A * | 7/1983 | Sarcia | 62/6 |
| 5,361,588 | A * | 11/1994 | Asami et al. | 62/6 |
| 2011/0061404 | A1 * | 3/2011 | Ishizuka et al. | 62/6 |
| 2012/0047913 | A1 * | 3/2012 | Mizuno | 62/6 |

FOREIGN PATENT DOCUMENTS

| | | | |
|---|---|---|---|
| JP | 58-089644 | U | 6/1983 |
| JP | 01-071211 | U | 5/1989 |
| JP | 05-157504 | | 6/1993 |
| JP | 06-042568 | | 2/1994 |
| JP | 08-303888 | | 11/1996 |
| JP | 2004-308944 | | 11/2004 |
| JP | 2007-205582 | | 8/2007 |
| JP | 2010-027988 | | 2/2010 |

OTHER PUBLICATIONS

International Search Report mailed on Jun. 28, 2011.

* cited by examiner

*Primary Examiner* — Melvin Jones
(74) *Attorney, Agent, or Firm* — IPUSA, PLLC

(57) ABSTRACT

A cryogenic refrigerator includes a cylinder configured to be fed with a refrigerant gas, a displacer configured to reciprocate in the cylinder, a drive unit configured to cause the displacer to reciprocate in the cylinder, and a connecting mechanism connecting the drive unit and the displacer. The connecting mechanism includes an output shaft extending from the drive unit toward the displacer, an engagement pin provided through the output shaft to extend in directions to cross the reciprocating directions of the displacer, a rotation prevention mechanism configured to engage with the engagement pin to prevent a further rotation of the displacer when the displacer rotates, and a lid body fixed to an end portion of the displacer and engaging with the output shaft.

5 Claims, 8 Drawing Sheets

CRYOGENIC REFRIGERATOR

CROSS-REFERENCE TO RELATED APPLICATIONS

This application is a continuation application filed under 35 U.S.C. 111(a) claiming benefit under 35 U.S.C. 120 and 365(c) of International Application PCT/JP2011/059052, filed on Apr. 12, 2011, and designated the U.S., which claims priority to Japanese Patent Application No. 2010-093281, filed on Apr. 14, 2010. The entire contents of the foregoing applications are incorporated herein by reference.

BACKGROUND OF THE INVENTION

1. Field of the Invention

The present invention relates generally to cryogenic refrigerators, and more particularly to a cryogenic refrigerator that includes a connecting mechanism that connects a drive unit and a displacer.

2. Description of the Related Art

In general, Gifford-McMahon (GM) refrigerators (hereinafter referred to as "GM refrigerators") are known as refrigerators that produce cryogenic temperatures. The GM refrigerator produces a cooling effect based on the Gifford-McMahon cycle in which the movement of a displacer containing a regenerator material and the adiabatic expansion of a refrigerant gas due to valve operations are linked with each other.

First, the GM refrigerator feeds a cylinder with a refrigerant gas whose pressure has been increased by a compressor. At this point, the displacer is at its bottom dead center. The displacer is caused to rise by a pressure difference in the refrigerant gas or by the force of a motor. When the displacer reaches its top dead center, the valve is switched to cause the refrigerant gas that has accumulated under the displacer to adiabatically expand, there by causing the refrigerant gas to be cooled and exchange heat with the regenerator material contained in the displacer. At this point, the displacer starts to lower, and when the displacer returns to the bottom dead center, the valve is switched to allow the refrigerant gas whose pressure has been increased by the compressor to reenter the cylinder, so that the refrigerant gas exchanges heat with the regenerator material inside the displacer to be cooled. By repeating this operation, a thermal load flange part on a lower end part of the cylinder is cooled. In general, the rotational motion of a motor is converted into a linear motion using a crank mechanism or a Scotch yoke mechanism, thereby causing the displacer to reciprocate. (See, for example, Japanese Laid-Open Patent Application No. 2007-205582.)

Conventionally, a connecting mechanism as illustrated in FIG. 1 and FIG. 2 is used to connect the reciprocating output shaft of the Scotch yoke mechanism to the displacer. The connecting mechanism includes a collar 102, a parallel pin 104, an upper cup 105, and a spring pin 107.

An output shaft 101 is a rod-shaped member, and is connected to a Scotch yoke mechanism (not graphically illustrated) to reciprocate in vertical directions as shown in FIG. 1. The annular collar 102 fits to a lower end part of the output shaft 101, and is fixed to the lower end part by the parallel pin 104 that passes through the collar 102 and the output shaft 101.

A shaft hole 103*a* is formed at the upper end of a displacer 103. The output shaft 101 and the collar 102 are inserted in the shaft hole 103*a*. Further, the upper cup 105 is fixed on the upper end face of the displacer 103 by a fixing bolt 106.

An opening 105*a* is formed in the center of the upper cup 105. The output shaft 101 extends upward through the opening 105*a*. Further, the diameter of the collar 102 is greater than the diameter of the opening 105*a*.

According to the above-described configuration, when the output shaft 101 moves upward in FIG. 1, the upper surface of the collar 102 is pulled in engagement with the upper cup 105, so that the displacer 103 moves upward inside a cylinder 100. Meanwhile, when the output shaft 101 moves downward in FIG. 1, the displacer 103 is pressed downward by the collar 102, so that the displacer 103 moves downward inside the cylinder 100. Thereby, the displacer 103 reciprocates inside the cylinder 100.

Further, the GM refrigerator produces cold temperatures by expanding a refrigerant gas inside the cylinder 100. Therefore, if the refrigerant gas flows between the inner wall surface of the cylinder 100 and the outer wall surface of the displacer 103 (that is, if a so-called blow-through of the refrigerant gas occurs), this causes a decrease in the cooling efficiency. Therefore, a sealing member 108 that comes into sliding contact with the cylinder 100 is provided on the side surface of the displacer 103 to prevent occurrence of a blow-through of the refrigerant gas.

If the displacer 103 rotates on a vertical axis during its reciprocation inside the cylinder 100, this changes the position of contact of the sealing member 108 provided on the side surface of the displacer 103 with the interior circumferential surface of the cylinder 100. This causes occurrence of a blow-through of the refrigerant gas, thus destabilizing cooling by the GM refrigerator. In order to prevent this, the above-described connecting mechanism is provided with a mechanism to prevent the rotation of the displacer 103 (a rotation prevention mechanism).

As illustrated in FIG. 2 as well as FIG. 1, according to the conventional rotation prevention mechanism, the spring pin 107 is press-fit into and fixed to the upper cup 105, and a groove 102*a* is formed in the collar 102 so that the spring pin 107 engages with the groove 102*a*. The output shaft 101 is prevented from rotating by being connected to a Scotch yoke, etc. Further, the displacer 103 is prevented from rotating relative to the output shaft 101 by the spring pin 107. According to the conventional rotation prevention mechanism, the rotation of the displacer 103 inside the cylinder 100 is thus prevented.

SUMMARY OF THE INVENTION

According to an aspect of the present invention, a cryogenic refrigerator includes a cylinder configured to be fed with a refrigerant gas; a displacer configured to reciprocate in the cylinder; a drive unit configured to cause the displacer to reciprocate in the cylinder; and a connecting mechanism connecting the drive unit and the displacer, the connecting mechanism including an output shaft extending from the drive unit toward the displacer; an engagement pin provided through the output shaft to extend in directions to cross reciprocating directions of the displacer; a rotation prevention mechanism configured to engage with the engagement pin to prevent a further rotation of the displacer when the displacer rotates; and a lid body fixed to an end portion of the displacer and engaging with the output shaft.

The object and advantages of the invention will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
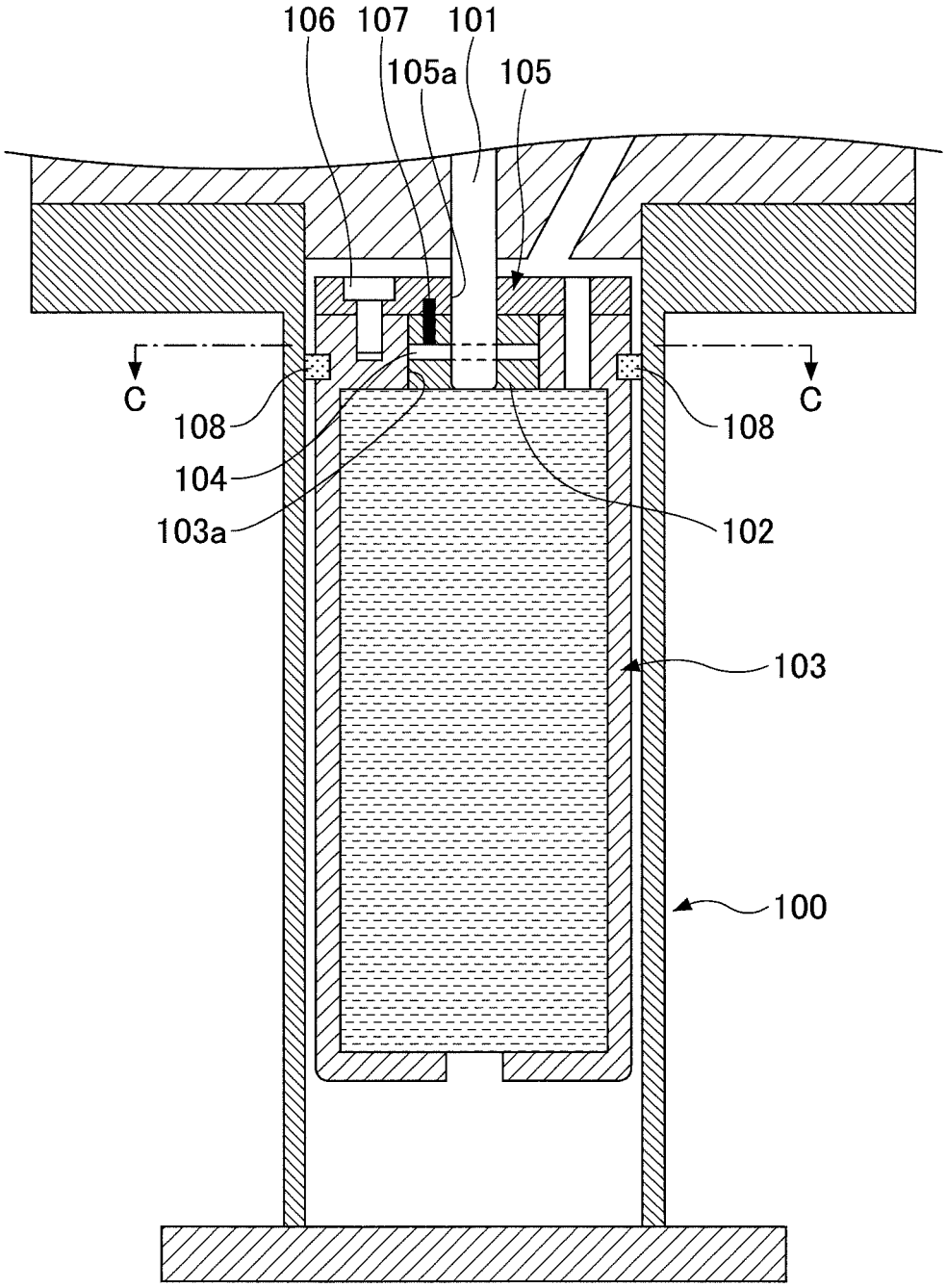
FIG.1 RELATED ART
FIG. 1 is an enlarged cross-sectional view of part of a conventional cryogenic refrigerator, illustrating a displacer and its neighborhood.

In the above-described conventional cryogenic refrigerator, however, the rotation of the displacer 103 is prevented by press-fitting and fixing the spring pin 107 to the upper cup 105 and engaging the press-fit spring pin 107 with the groove 102*a* formed in the collar 102. Therefore, if a force to rotate the displacer 103 acts on the displacer 103, this entire force is applied to the spring pin 107.

Therefore, the conventional cryogenic refrigerator has a problem in that the spring pin 107 may be broken. The breakage of the spring pin 107 allows the displacer 103 to rotate inside the cylinder 100, thus destabilizing cooling by the cryogenic refrigerator.

According to an aspect of the present invention, an improved and useful cryogenic refrigerator is provided in which the above-described problem may be solved.

According to an aspect of the present invention, a cryogenic refrigerator is provided that stabilizes cooling by preventing the rotation of a displacer.

According to an aspect of the present invention, the rotation of a displacer is prevented by a rotation prevention mechanism, so that it is possible to execute a stable cooling process.

A description is given below, with reference to the accompanying drawings, of embodiments of the present invention.

FIG. 3, FIG. 4, FIG. 5, and FIG. 6 are diagrams for illustrating a cryogenic refrigerator according to an embodiment of the present invention. In this embodiment, a description is given taking a GM refrigerator as an example of the cryogenic refrigerator.

The GM refrigerator according to this embodiment includes a gas compressor 1 and a cold head 2. The cold head 2 includes a housing 23 and a cylinder part 10. The gas compressor 1 takes in a refrigerant gas from an inlet port 1*a*, compresses the refrigerant gas, and discharges a high-pressure refrigerant gas from an outlet port 1*b*. Helium gas is used as the refrigerant gas.

The cylinder part 10, which has a two-stage structure, includes a first-stage cylinder 10A and a second-stage cylinder 10B. The second-stage cylinder 10B is thinner than the first-stage cylinder 10A. A first-stage displacer 3A and a second-stage displacer 3B are so inserted in the first-stage cylinder 10A and the second-stage cylinder 10B as to be reciprocatable in the axial directions of the first-stage cylinder 10A and the second-stage cylinder 10B, respectively.

The first-stage displacer 3A and the second-stage displacer 3B are connected to each other by a joint mechanism (not graphically illustrated). A regenerator material 4A is provided inside the first-stage displacer 3A, and a regenerator material 4B is provided inside the second-stage displacer 3B. Further, gas passages L1, L2, L3, and L4 through which a refrigerant gas passes are formed in the first-stage displacer 3A and the second-stage displacer 3B.

A first-stage expansion chamber 11 and an upper chamber 13 are formed in a lower end portion on the second-stage cylinder 10B side and in an upper end portion on the other side, respectively, inside the first-stage cylinder 10A. Further, a second-stage expansion chamber 12 is formed in a lower end portion on the side opposite to the first-stage cylinder 10A side inside the second-stage cylinder 10B.

The upper chamber 13 and the first-stage expansion chamber 11 are connected via the gas passage L1, a first-stage regenerator material filling chamber filled with the regenerator material 4A, and the gas passage L2. The first-stage expansion chamber 11 and the second-stage expansion chamber 12 are connected via the gas passage L3, a second-stage regenerator material filling chamber filled with the regenerator material 4B, and the gas passage L4.

A cooling stage 6 is provided at a position substantially corresponding to the first-stage expansion chamber 11 on the exterior circumferential surface of the first-stage cylinder 10A. A cooling stage 7 is provided at a position substantially corresponding to the second-stage expansion chamber 12 on the exterior circumferential surface of the second-stage cylinder 10B.

A sealing member 50 is provided at a position near an upper chamber 13 side end on the exterior circumferential surface of the first-stage displacer 3A. The sealing member 50 seals the space between the exterior circumferential surface of the first-stage displacer 3A and the interior circumferential surface of the first-stage cylinder 10A.

As described above, the occurrence of a blow-through of a refrigerant gas between the inner wall surface of the first-stage cylinder 10A and the outer wall surface of the first-stage displacer 3A would reduce the cooling effect of the GM refrigerator. Therefore, the sealing member 50 that comes into sliding contact with the interior circumferential surface of the first-stage cylinder 10A is provided on the exterior circumferential surface of the first-stage displacer 3A in order to prevent occurrence of a blow-through of a refrigerant gas.

The first-stage displacer 3A is connected via a connecting mechanism (to be described below in more detail) to an output shaft 22*a* of a Scotch yoke 22 that forms part of a rotation/reciprocation conversion mechanism. The Scotch yoke 22 is so supported by a pair of sleeve bearings 17*a* and 17*b* fixed to the housing 23 as to be movable in the axial directions of the first-stage displacer 3A. In the sleeve bearing 17*b*, the airtightness of the sliding part is maintained, so that the space inside the housing 23 and the upper chamber 13 are partitioned in an airtight manner.

A motor 15 is connected to the Scotch yoke 22. The rotation of the motor 15 is converted into reciprocation by a crank 14 and the Scotch yoke 22. This reciprocation is transmitted to the first-stage displacer 3A via the output shaft 22*a* and the connecting mechanism. As a result, the first-stage displacer 3A reciprocates inside the first-stage cylinder 10A, and the second-stage displacer 3B reciprocates inside the second-stage cylinder 10B. According to this embodiment, the motor 15 and the Scotch yoke 22 (including the output shaft 22*a*) may form a drive unit.

Figure 3:
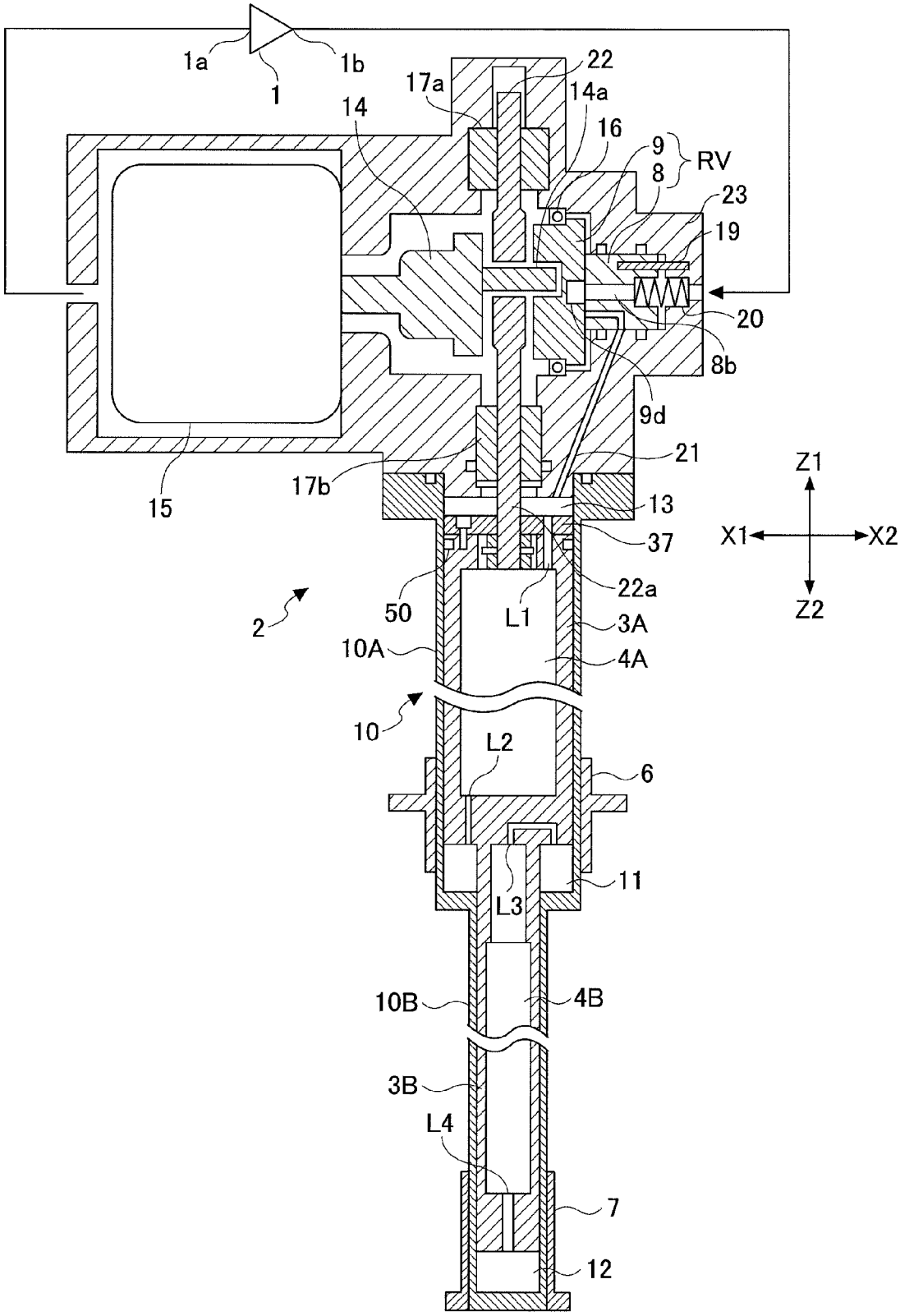
FIG. 3 is a cross-sectional view of a cryogenic refrigerator according to an embodiment of the present invention.

When the first-stage displacer 3A and the second-stage displacer 3B move upward in FIG. 3 (in the Z1 direction), the volume of the upper chamber 13 decreases while the volumes of the first-stage expansion chamber 11 and the second-stage expansion chamber 12 increase. Meanwhile, when the first-stage displacer 3A and the second-stage displacer 3B move downward in FIG. 3 (in the Z2 direction), the volume of the upper chamber 13 increases while the volumes of the first-stage expansion chamber 11 and the second-stage expansion chamber 12 decrease. With these changes in the volumes of the upper chamber, the first-stage expansion chamber 11, and the second-stage expansion chamber 12, the refrigerant gas moves through the gas passages L1 through L4.

Further, when the refrigerant gas passes through the regenerator materials 4A and 4B that fill in the first-stage and second-stage displacers 3A and 3B, respectively, heat is exchanged between the refrigerant gas and the regenerator materials 4A and 4B. As a result, the regenerator materials 4A and 4B are cooled by the refrigerant gas.

In the passage of the refrigerant gas, a rotary valve RV is provided between the upper chamber 13 and the inlet port 1*a* and the outlet port 1*b* of the gas compressor 1. The rotary valve RV operates to switch the passage of the refrigerant gas (from one to another). For example, the rotary valve RV switches a first mode in which the refrigerant gas discharged from the outlet port 1*b* of the gas compressor 1 is guided into the upper chamber 13 and a second mode in which the refrigerant gas inside the upper chamber 13 is guided to the inlet port 1*a* of the gas compressor 1.

The rotary valve RV includes a valve body 8 and a valve plate 9. The valve plate 9 is formed of, for example, an aluminum alloy. The valve body 8 is formed of, for example, tetrafluoroethylene (for example, BEAREE FL3000 manufactured by NTN Corporation). The valve body 8 and the valve plate 9 have respective flat slide surfaces 8*a* and 9*a* (FIG. 4), and these flat side surfaces 8*a* and 9*a* are in surface contact with each other. Preferably, a thin film of a rigid material such as diamond-like carbon (DLC) is formed on at least one of the slide surfaces 8*a* and 9*a* in order to reduce friction to improve the abrasion resistance of the slide surfaces 8*a* and 9*a*.

The valve plate 9 is so supported by a rolling bearing 16 as to be rotatable inside the housing 23. An eccentric pin 14*a* of the crank 14, which drives the Scotch yoke 22, revolves around an axis of rotation, thereby causing the valve plate 9 to rotate. The valve body 8 is pressed against the valve plate 9 by a coil spring 20, and is locked (fixed) by a pin 19 so as not to rotate.

The coil spring 20 is a pressing part provided in order to press the valve body 8 so that the valve body 8 is prevented from being separated from the valve plate 9 when the discharge-side pressure becomes higher than the feed-side pressure. A force to press the valve body 8 against the valve plate 9 at the time of operation is generated by a pressure difference between the refrigerant gas feed side and the refrigerant gas discharge side acting on the valve body 8.

Figure 4:
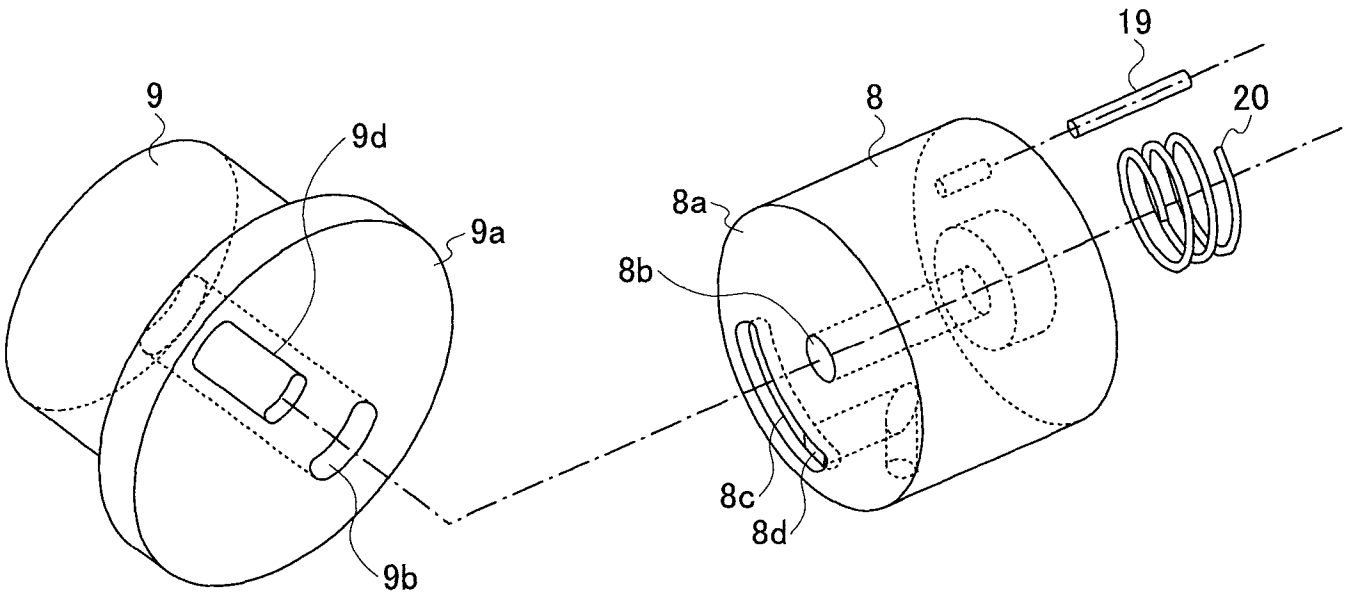
FIG. 4 is an exploded perspective view of a rotary valve provided in the cryogenic refrigerator according to the embodiment of the present invention.

FIG. 4 is an exploded perspective view of the rotary valve RV. The flat slide surface 8*a* of the columnar valve body 8 and the flat slide surface 9*a* of the valve plate 9 come into surface contact. A gas passage 8*b* that serves as a gas feed passage penetrates through the valve body 8 along the central axis of the valve body 8. That is, one end of the gas passage 8*b* is open at the slide surface 8*a*.

The other end of the gas passage 8*b* is connected to the outlet port 1*b* of the gas compressor 1 illustrated in FIG. 3. The gas passage from the outlet port 1*b* of the gas compressor 1 through the gas passage 8*b* of the valve body 8 corresponds to the gas feed passage.

Further, a groove 8*c* is formed along an arc (of a circle) having a center at the central axis of the valve body 8 on the slide surface 8*a* of the valve body 8. One end of a gas passage 8*d* formed inside the valve body 8 is open at the bottom surface of the groove 8*c*. The other end of the gas passage 8*d* is open at the exterior circumferential surface of the valve body 8 to further communicate with the upper chamber 13 via a gas passage 21 formed in the housing 23 as illustrated in FIG. 3.

A groove 9*d* is formed on the slide surface 9*a* of the valve plate 9 to extend radially from the center of the slide surface 9*a*. When the valve plate 9 rotates so that the peripheral-side end portion of the groove 9*d* overlaps (in part) with the groove 8*c* of the slide surface 8*a* of the valve body 8, the gas passage 8*b* and the gas passage 8*d* communicate with each other via the groove 9*d*.

A gas passage 9*b* extends parallel to the axis of rotation through the valve plate 9. The gas passage 9*b* is open at substantially the same radial position on the slide surface 9*a* as the groove 8*c* is formed on the slide surface 8*a* of the valve body 8. When the valve plate 9 rotates so that the opening of the gas passage 9*b* overlaps (in part) with the groove 8*c* of the valve body 8, the gas passage 8*d* and the gas passage 9*b* communicate with each other. The other end of the gas passage 9*b* communicates with the inlet port 1*a* of the gas compressor 1 via a hollow inside the housing 23 as illustrated in FIG. 3. The gas passage from the gas passage 9*b* to the inlet port 1*a* of the gas compressor 1 corresponds to the gas discharge passage.

When the gas passage 8*b* and the gas passage 8*d* communicate with each other via the groove 9*d* and the groove 8*c*, a refrigerant gas is fed from the gas compressor 1 into the upper chamber 13 via the rotary valve RV. When the gas passage 8*d* and the gas passage 9*b* communicate with each other, the refrigerant gas inside the upper chamber 13 is collected into the gas compressor 1. Accordingly, by rotating the valve plate 9, the introduction (feeding) of a refrigerant gas into the upper chamber 13 and the collection (discharge) of a refrigerant gas from the upper chamber 13 are repeated.

Figure 5:
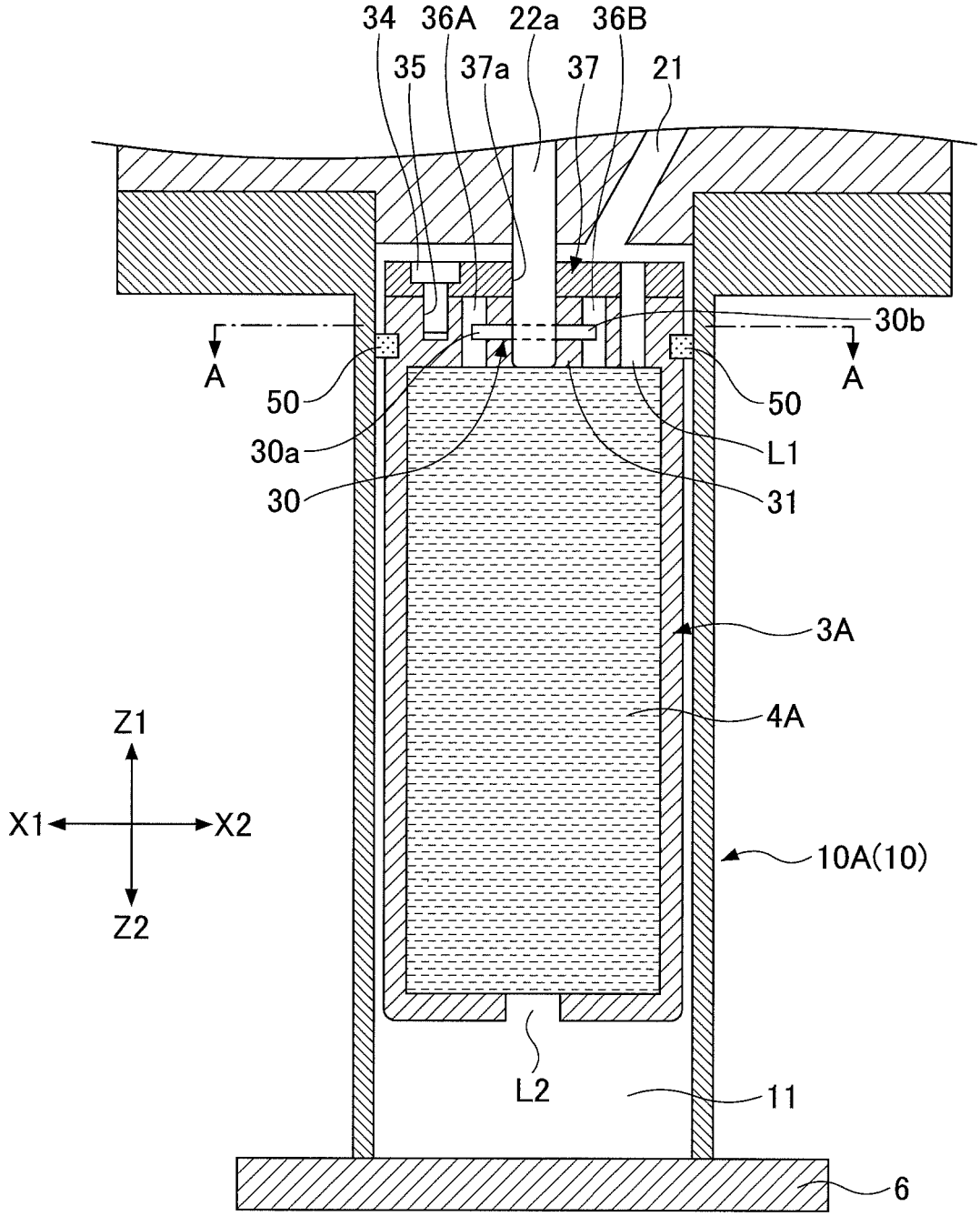
FIG. 5 is an enlarged cross-sectional view of part of the cryogenic refrigerator according to the embodiment of the present invention, illustrating a displacer and its neighborhood.
Figure 6:
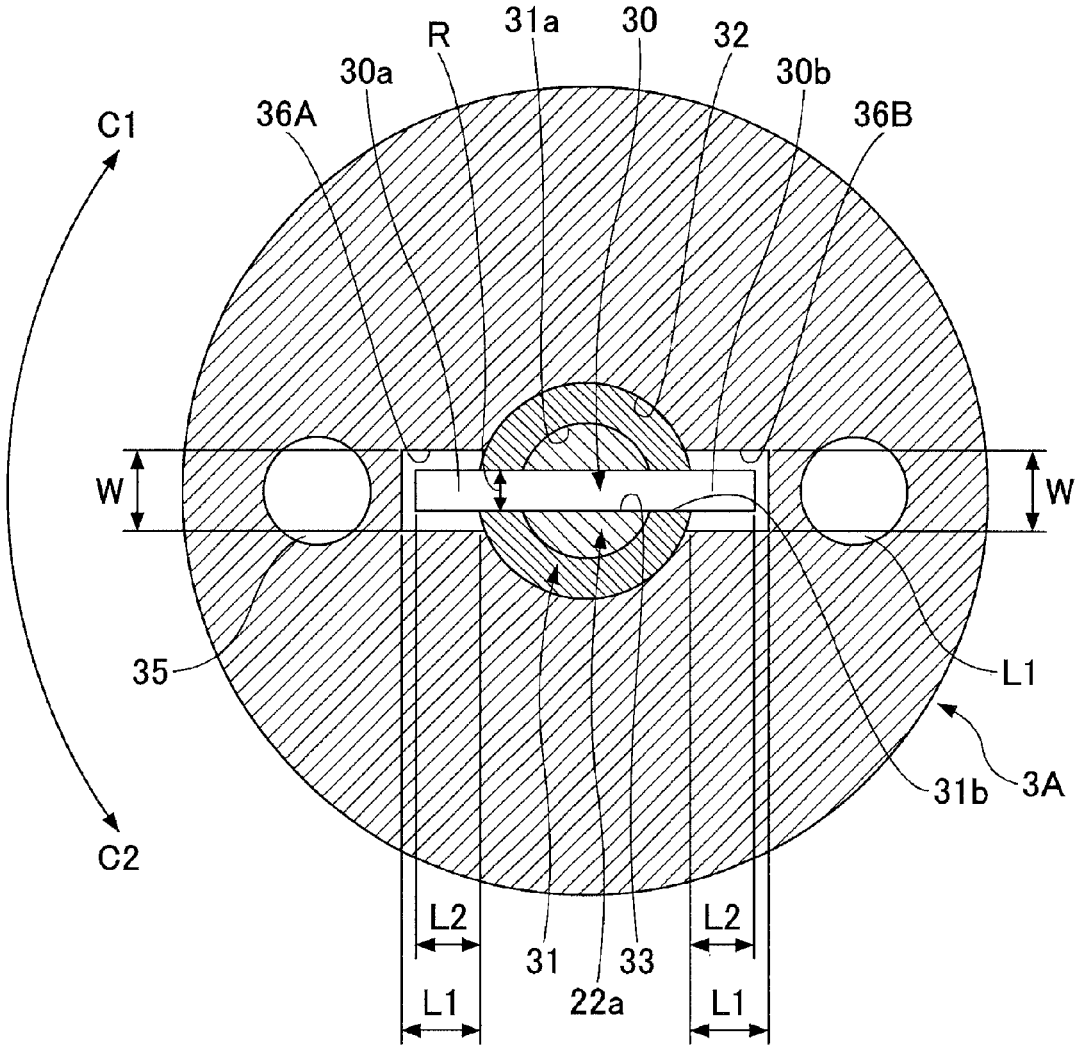
FIG. 6 is a cross-sectional view taken along line A-A in FIG. 5.

Next, a description is given, with reference basically to FIG. 5 and FIG. 6, of the connecting mechanism that connects the output shaft 22*a*, which is the reciprocating member of the Scotch yoke 22, and the first-stage displacer 3A in the GM refrigerator configured as described above. FIG. 5 is an enlarged view of a connecting portion of the output shaft 22*a* and the first-stage displacer 3A. FIG. 6 is a cross-sectional view taken along line A-A in FIG. 5.

The connecting mechanism that connects the output shaft 22*a* and the first-stage displacer 3A (hereinafter simply referred to as "displacer 3A") includes the output shaft 22*a*, an engagement pin 30, a collar 31, a shaft hole 32, an upper cup 37, and a rotation prevention mechanism. The rotation prevention mechanism according to this embodiment includes engagement grooves 36A and 36B.

A through hole 33 is formed in the output shaft 22*a* near its lower end so as to extend in directions (indicated by arrows X1 and X2 in FIG. 3 and FIG. 5) perpendicular to the reciprocating directions of the displacer 3A (in which the displacer 3A reciprocates) (indicated by arrows Z1 and Z2 in FIG. 3 and FIG. 5). The engagement pin 30 is so attached as to pass through the through hole 33. Therefore, the engagement pin 30 is thus attached to extend in the directions (the X1 and the X2 direction) perpendicular to the reciprocating directions of the displacer 3A. Further, the length of the engagement pin 30 is greater than the diameter of the output shaft 22*a*, so that the engagement pin 30 has both end portions 30*a* and 30*b* extending outward from the output shaft 22*a*.

The collar 31 is provided on a lower end portion of the output shaft 22*a*. An insertion hole 31*a* for inserting the output shaft 22*a* is formed in the center of the collar 31, so that the collar 31 has a hollow columnar structure. The collar 31 is formed of, for example, stainless steel. Further, an insertion hole 31*b* is formed in the collar 31 so as to extend in the directions perpendicular to the reciprocating directions of the displacer 3A.

With the collar 31 being attached to a predetermined attachment position on the output shaft 22*a*, the through hole 33 formed in the output shaft 22*a* and the insertion hole 31*b* formed in the collar 31 communicate in alignment with each other. The engagement pin 30 is inserted into the insertion hole 31*b* and the through hole 33 thus communicating with each other (to be attached to the collar 31 and the output shaft 22*a*). The engagement pin 30 is longer than the diameter of the collar 31, so that the engagement pin 30 has the end portions 30*a* and 30*b* extending outward from the exterior circumferential surface of the collar 31 even with the engagement pin 30 being attached to the collar 31 and the output shaft 22*a*.

Further, with the engagement pin 30 being attached to the collar 31 and the output shaft 22*a*, the collar 31 is held on the output shaft 22*a* via the engagement pin 30. Accordingly, when the output shaft 22*a* moves in the reciprocating directions (the Z1 and the Z2 direction) of the displacer 3A, the collar 31 also moves in the reciprocating directions (the Z1 and the Z2 direction) together (as a unit) with the output shaft 22*a*.

The shaft hole 32 and the engagement grooves 36A and 36B are formed in an upper end portion (a Z1 directional end portion) of the displacer 3A. The shaft hole 32 is coaxial with the central axis of the columnar displacer 3A. The diameter of the shaft hole 32 is slightly greater than the diameter of the collar 31. That is, the shaft hole 32 allows insertion of the output shaft 22*a* to which the collar 31 is attached. The length of the engagement pin 30 is greater than the diameter of the shaft hole 32.

The engagement grooves 36A and 36B are formed in the sidewall of the shaft hole 32. The engagement grooves 36A and 36B are 180° apart, so that the engagement groove 36A and the engagement groove 36B face each other (across the shaft hole 32). The engagement holes 36A and 36B have the same shape, so that the engagement holes 36A and 36B have the same length (indicated by arrows L1 in FIG. 6) and the same width (indicated by arrows W in FIG. 6).

Further, the length L1 of each of the engagement grooves 36A and 36B is greater than a length (indicated by arrows L2 in FIG. 6) by which each of the end portions 30*a* and 30*b* of the engagement pin 30 projects outward from the exterior circumferential surface of the collar 31 (L1>L2). That is, the length L1 of each of the engagement grooves 36A and 36B is greater than the length L2 of each of parts of the engagement pin 30 projecting outward from the exterior circumferential surface of the collar 31. Further, the width W of each of the engagement grooves 36A and 36B is greater than the diameter of the cross section of the engagement pin 30 (indicated by arrow R in FIG. 6) (W>R). Accordingly, by inserting the output shaft 22*a* to which the engagement pin 30 and the collar 31 are attached into the shaft hole 32, the end portions 30*a* and 30*b* of the engagement pin 30 are inserted into and accommodated in the engagement grooves 36A and 36B, respectively (as illustrated in FIG. 6).

The upper cup 37 serves as a lid (lid body) to close the upper end portion of the displacer 3A. The upper cup 37, which is formed of aluminum, has a disk shape with an insertion hole 37*a* formed in its center. The output shaft 22*a* is inserted in the insertion hole 37*a*. A hole forming part of the gas passage L1 and an attachment recess for attaching a fixing bolt 34 are formed in the upper cup 37.

The fixing bolt 34 is inserted in the attachment recess and mates with a screw hole 35 formed in the upper end portion of the displacer 3A, so that the upper cup 37 is fixed to the displacer 3A. In this state of fixation, the collar 31 is positioned below the upper cup 37. Further, the diameter of the insertion hole 37*a* formed in the upper cup 37 is smaller than the diameter of the collar 31. Accordingly, with the upper cup 37 being fixed to the displacer 3A, the collar 31 is in engagement (contact) with the upper cup 37.

According to this configuration, when the drive unit performs driving to cause the output shaft 22*a* to rise (move upward in the Z1 direction), the collar 31 attached to the output shaft 22*a* by the engagement pin 30 also rises. At this point, since the collar 31 is in engagement with the upper cup 37, the upper cup 37 is also urged to rise with the rising of the collar 31.

Accordingly, with the rising of the output shaft 22*a*, the collar 31 in engagement with the upper cup 37 urges the displacer 3A to move upward. That is, the upper cup 37 engages with the output shaft 22*a* via the collar 31. Accordingly, the displacer 3A is caused to rise by the rising of the output shaft 22*a*.

Further, when the output shaft 22*a* lowers, the displacer 3A is caused to lower by the lowering of the output shaft 22*a* for the same reason as stated above. Therefore, according to the connecting mechanism of this embodiment, the displacer 3A may be caused to move upward and downward by the upward and downward movements of the output shaft 22*a* of the drive unit.

Here, it is assumed that a force is exerted (applied) on the displacer 3A in its rotational direction (indicated by arrow C1 or C2 in FIG. 6) in the connecting mechanism according to this embodiment.

For example, it is assumed that a force to rotate the displacer 3A in the direction indicated by arrow C1 in FIG. 6 acts on the displacer 3A. In this case, with the rotation of the displacer 3A in the C1 direction, the engagement grooves 36A and 36B also rotate in the C1 direction. Therefore, with the rotation in the C1 direction, an inner wall surface of the engagement groove 36A engages (comes into contact) with the end portion 30*a* of the engagement pin 30, and an inner wall surface of the engagement groove 36B engages (comes into contact) with the end portion 30*b* of the engagement pin 30.

However, the output shaft 22*a*, which is connected to the Scotch yoke mechanism of the drive unit as described above, is prevented from rotating, so that the engagement pin 30 passing through the through hole 33 of the output shaft 22*a* is also prevented from rotating. Therefore, after the inner wall surfaces of the engagement grooves 36A and 36B engage with the end portions 30*a* and 30*b*, respectively, of the engagement pin 30, the displacer 3A is prevented from rotating further in the C1 direction.

Further, the same is the case with when a force to rotate the displacer 3A in the direction indicated by arrow C2 in FIG. 6 acts on the displacer 3A. In this case, with the rotation in the C2 direction, another inner wall surface of the engagement groove 36A engages (comes into contact) with the end portion 30*a* of the engagement pin 30, and another inner wall surface of the engagement groove 36B engages (comes into contact) with the end portion 30*b* of the engagement pin 30. Accordingly, after the inner wall surfaces of the engagement grooves 36A and 36B engage with the end portions 30*a* and 30*b*, respectively, of the engagement pin 30, the displacer 3A is prevented from rotating further in the C2 direction.

Figure 2:
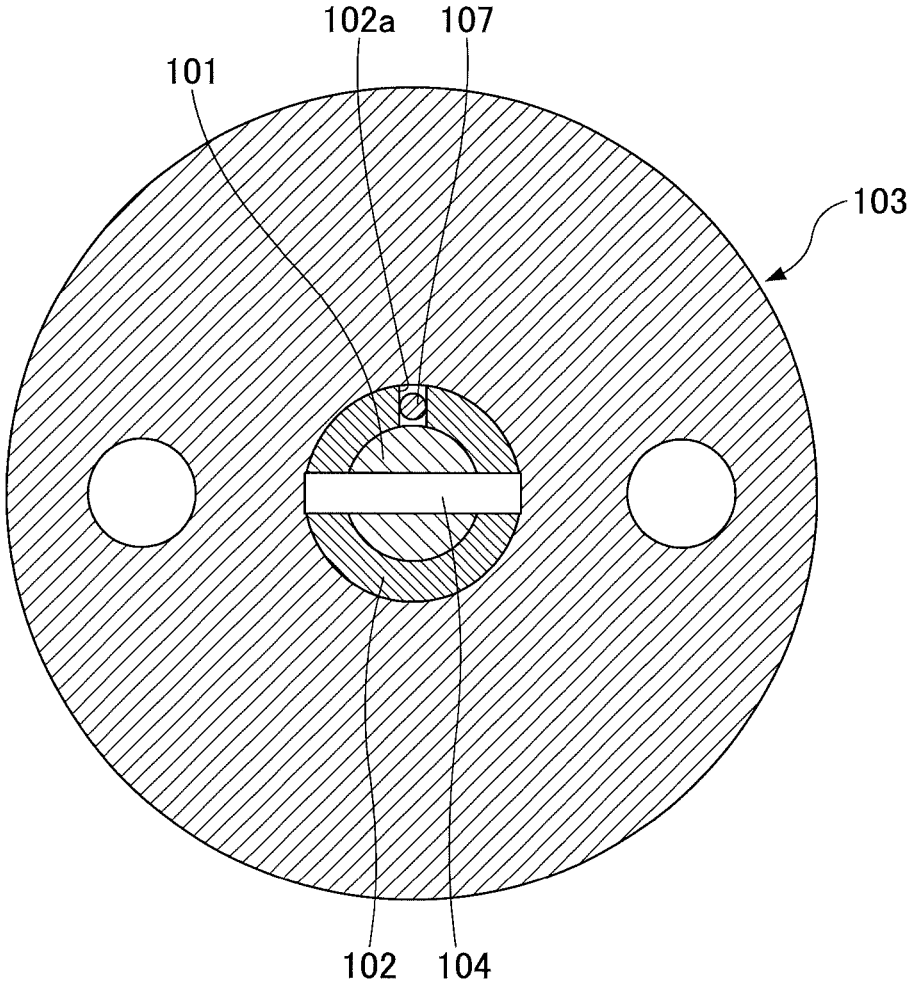
FIG.2 RELATED ART
FIG. 2 is a cross-sectional view taken along line C-C in FIG. 1.

According to this embodiment, the rotation of the displacer 3A is restricted by the end portions 30*a* and 30*b* of the engagement pin 30 engaging with the paired engagement grooves 36A and 36B, respectively, forming the rotation prevention mechanism. That is, while the rotation of the displacer 103 is restricted by the spring pin 107 alone, that is, the rotation of the displacer 103 is restricted at one point, according to the conventional configuration as illustrated in FIG. 1 and FIG. 2, it is possible to restrict the rotation of the displacer 3A at two points according to this embodiment.

Accordingly, it is possible to reduce a shear force applied to the end portions 30*a* and 30*b* of the engagement pin 30 at the time of restricting the rotation of the displacer 3A compared with the conventional configuration, so that it is possible to prevent the breakage of the engagement pin 30 at the time of restricting the rotation of the displacer 3A. This prevents the sealing member 50 provided on the displacer 3A from being separated from the first-stage cylinder 10A to cause occurrence of a blow-through of a refrigerant gas, so that it is possible to stabilize cooling by the GM refrigerator.

Further, according to this embodiment, a metal (for example, stainless steel) solid round bar is employed as the engagement pin 30. Therefore, the strength of the engagement pin 30 is higher than the conventional spring pin 107. This also contributes to the prevention of the breakage of the engagement pin 30.

Further, according to this embodiment, the conventionally required spring pin 107 is unnecessary, so that there is no need to faun a fixation hole for fixing the spring pin 107 to the upper cup 105.

Further, according to this embodiment, there is no need to form the groove 102*a* in the collar 102, which is a component smaller than the displacer 103. Therefore, according to the GM refrigerator of this embodiment, it is possible to reduce the number of components and simplify the manufacturing process compared with the conventional refrigerator.

Figure 7:
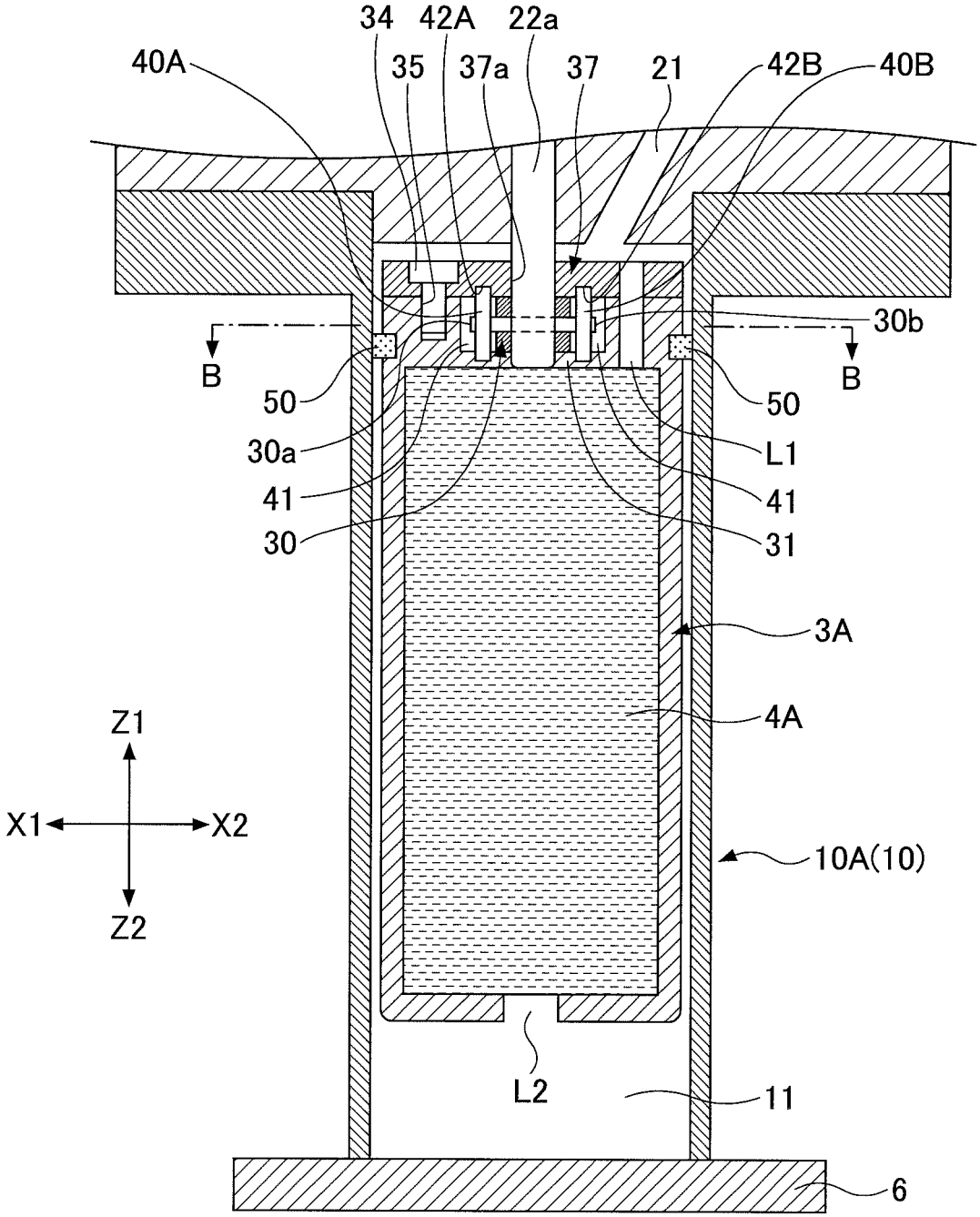
FIG. 7 is an enlarged cross-sectional view of the cryogenic refrigerator according to a variation of the embodiment of the present invention, illustrating a displacer and its neighborhood.
Figure 8:
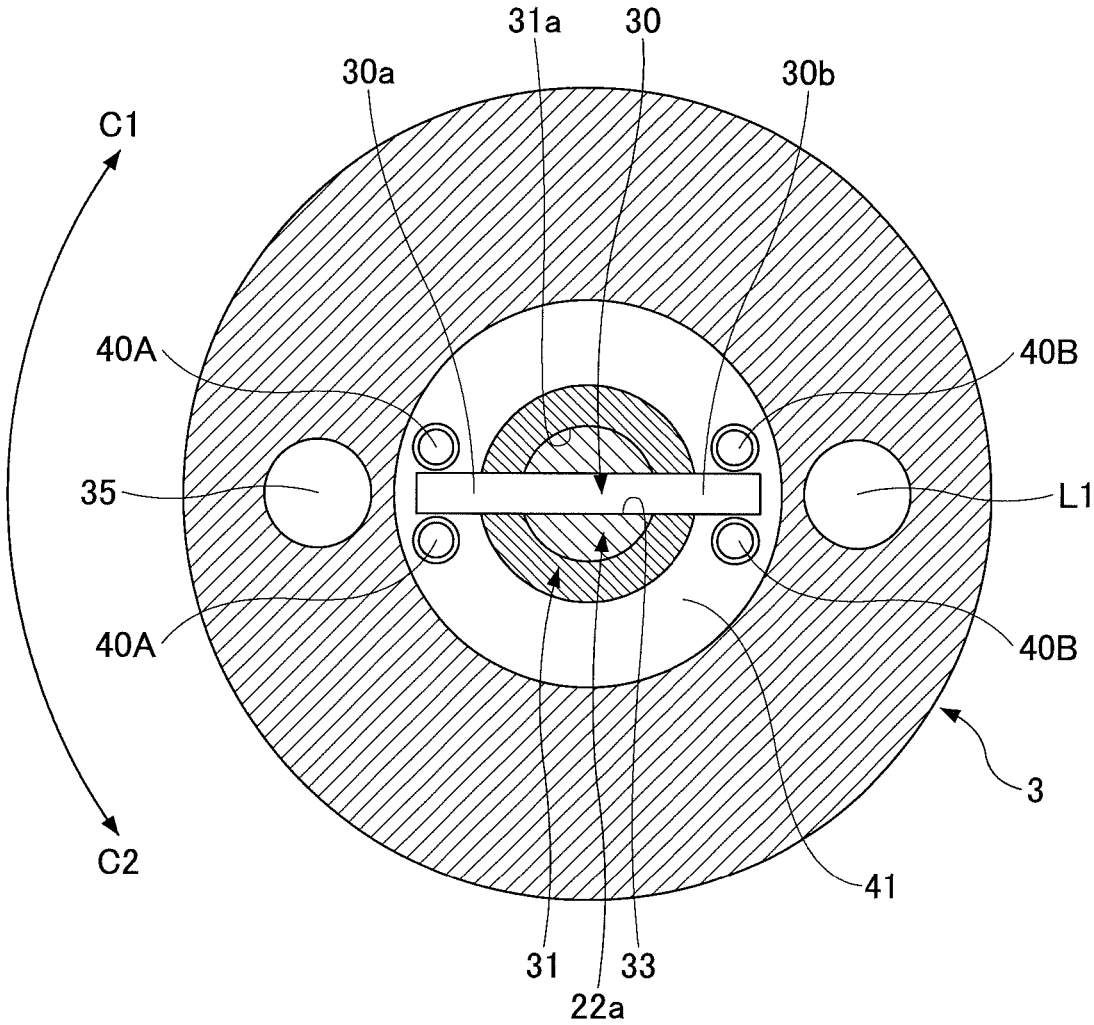
FIG. 8 is a cross-sectional view taken along line B-B in FIG. 7.

FIG. 7 and FIG. 8 are diagrams illustrating a variation of the above-described connecting mechanism. According to the connecting mechanism of the above-described embodiment, the engagement grooves 36A and 36B are provided as a rotation prevention mechanism, and when the first-stage displacer 3A rotates in the C1 or C2 direction, the engagement pin 30 engages (comes into contact) with the engagement grooves 36A and 36B, thereby preventing the rotation of the first-stage displacer 3A.

Meanwhile, according to this variation, standing pins that are provided to stand on the upper end portion of the first-stage displacer 3A are used as the rotation prevention mechanism of the connecting mechanism. According to this variation, a pair of bolts 40A and a pair of bolts 40B (hereinafter referred to as "engagement bolts 40A and 40B") are used as standing pins.

The two engagement bolts 40A are provided adjacent to the end portion 30*a* of the engagement pin 30, and the two engagement bolts 40B are provided adjacent to the end portion 30*b* of the engagement pin 30. Therefore, according to this variation, the four engagement bolts 40A and 40B in total are provided on the upper end portion of the first-stage displacer 3A.

The standing pins are not limited to bolts, and may be components having other configurations as long as the components may be provided to stand on the upper end portion of the first-stage displacer 3A.

A circular recess (depressed portion) 41 (hereinafter referred to as "upper end recess 41") is formed in the upper end portion of the first-stage displacer 3A. The output shaft 22*a* is inserted through the upper end recess 41 at its center position. Further, the diameter of the upper end recess 41 is greater than the length of the engagement pin 30.

Further, four screw holes are formed at the bottom of the upper end recess 41. The four engagement bolts 40A and 40B are provided to stand on the first-stage displacer 3A (more specifically, the bottom surface of the upper end recess 41) by mating with these screw holes. That is, the engagement bolts 40A and 40B include respective screw portions at their lower ends (threaded lower end portions) that mate with the screw holes formed at the bottom of the upper end recess 41.

Referring to FIG. 6, the engagement bolts 40A are provided to stand at positions across the end portion 30*a* of the engagement pin 30 from each other with the output shaft 22*a* being attached to the first-stage displacer 3A. Likewise, the engagement bolts 40B are provided to stand at positions across the end portion 30*b* of the engagement pin 30 from each other with the output shaft 22*a* being attached to the first-stage displacer 3A.

Meanwhile, engagement recesses (depressed portions) 42A and 42B are formed in the upper cup 37 at positions corresponding to the respective positions of the engagement bolts 40A and 40B (at which the engagement bolts 40A and 40B are provided). The engagement recesses 42A and 42B engage with the upper end portions of the engagement bolts 40A and 40B, respectively, provided to stand on the collar 31 when the upper cup 37 is attached to the first-stage displacer 3A (see FIG. 7).

Thus, the engagement bolts 40A and 40B are fixed by having their respective lower end portions fastened to the first-stage displacer 3A and having their respective upper end portions engaging with the engagement recesses 42A and 42B, respectively, of the upper cup 37. Thus, the respective upper end portions and lower end portions of the engagement bolts 40A and 40B are fixed, so that the strength of the engagement bolts 40A and 40B is increased.

It is assumed that a force is exerted (applied) on the displacer 3A in a rotational direction (indicated by arrow C1 or C2 in FIG. 8) in the connecting mechanism configured as described above according to this variation.

For example, it is assumed that a force to rotate the displacer 3A in the direction indicated by arrow C1 in FIG. 8 acts on the displacer 3A. In this case, with the rotation of the displacer 3A in the C1 direction, the engagement bolts 40A and 40B also rotate in the C1 direction. Therefore, with this rotation in the C1 direction, one of the engagement bolts 40A (the engagement bolt 40A in the lower position in FIG. 8) engages (comes into contact) with the end portion 30*a* of the engagement pin 30. Likewise, one of the engagement bolts 40B (the engagement bolt 40B in the upper position in FIG. 8) engages (comes into contact) with the end portion 30*b* of the engagement pin 30.

The output shaft 22*a*, which is connected to the Scotch yoke mechanism of the drive unit as described above, is prevented from rotating, so that the engagement pin 30 passing through the through hole 33 of the output shaft 22*a* is also prevented from rotating. Therefore, after the engagement pins 40A and 40B engage with the end portions 30*a* and 30*b*, respectively, of the engagement pin 30, the displacer 3A is prevented from rotating further in the C1 direction.

Further, the same is the case with when a force to rotate the displacer 3A in the direction indicated by arrow C2 in FIG. 8 acts on the displacer 3A. In this case, with the rotation in the C2 direction, the engagement bolts 40A and 40B different from those engaging the end portions 30*a* and 30*b* at the time of the rotation in the C1 direction engage (come into contact) with the end portions 30*a* and 30*b*, respectively, thereby restricting (preventing) a further rotation of the displacer 3A in the C2 direction.

Thus, according to this variation, the rotation of the displacer 3A is restricted by the end portions 30*a* and 30*b* of the engagement pin 30 engaging with the engagement bolts 40A and 40B, respectively, forming the rotation prevention mechanism.

The engagement bolts 40A and 40B have a rigid configuration with their respective upper end portions and lower end portions fixed to the upper cup 37 and the first-stage displacer 3A, respectively. Therefore, it is possible to ensure prevention of the rotation of the first-stage displacer 3A. Further, the rigid configuration of the engagement bolts 40A and 40B makes it possible to prevent the engagement bolts 40A and 40B from being damaged when the engagement bolts 40A and 40B engage with the engagement pin 30.

According to this variation, the engagement bolts 40A and 40B are used as standing pins, and are fixed by mating with the corresponding screw holes formed at the bottom of the upper end recess 41. Alternatively, the standing pins may be fixed to the bottom surface of the upper end recess 41 using an adhesive agent.

Further, according to this variation, the four engagement bolts 40A and 40B are configured to engage with the engagement pin 30. This may be replaced with a configuration where two engagement pins engage with only one of the end portions 30*a* and 30*b* of the engagement pin 30.

For example, the two engagement bolts 40A may be provided adjacent to the end portion 30*a* of the engagement pin 30 without providing the engagement bolts 40B, or the two engagement bolts 40B may be provided adjacent to the end portion 30*b* of the engagement pin 30 without providing the engagement bolts 40A.

Further, one of the engagement bolts 40A and one of the engagement bolts 40B may be provided adjacent to the end portions 30*a* and 30*b*, respectively, on the same side of the engagement pin 30.

For example, in the configuration of FIG. 8, the engagement bolts 40A and 40B on the lower side of the engagement pin 30 may be removed to leave the engagement bolts 40A and 40B on the upper side of the engagement pin 30. Alternatively, in the configuration of FIG. 8, the engagement bolts 40A and 40B on the upper side of the engagement pin 30 may be removed to leave the engagement bolts 40A and 40B on the lower side of the engagement pin 30.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, embodiments of the present invention may be applied to not only two-stage GM refrigerators but also one-stage or multiple (three or more) stage GM refrigerators. Further, embodiments of the present invention may be applied to not only GM refrigerators that generate reciprocation with a Scotch yoke mechanism but also GM refrigerators that generate reciprocation with other mechanisms such as a crank mechanism.

Further, the displacer 3A may be completely fixed to the output shaft 22*a*. However, since the displacer 3A is configured to reciprocate inside the cylinder part 10, it is desirable to allow the displacer 3A to rotate to some extent as long as no blow-through of a refrigerant gas is caused. According to the above-described embodiment, this allowance for rotation may be easily determined by adjusting the width of the engagement grooves 36A and 36B relative to the diameter R of the engagement pin 30.

What is claimed is:

1. A cryogenic refrigerator, comprising:
- a cylinder configured to be fed with a refrigerant gas;
- a displacer configured to reciprocate in the cylinder;
- a drive unit configured to cause the displacer to reciprocate in the cylinder; and
- a connecting mechanism connecting the drive unit and the displacer,
- the connecting mechanism including
  - an output shaft extending from the drive unit toward the displacer;
  - an engagement pin provided through the output shaft to extend in directions to cross reciprocating directions of the displacer;
  - a rotation prevention mechanism configured to engage with the engagement pin to prevent a further rotation of the displacer when the displacer rotates; and
  - a lid body fixed to an end portion of the displacer and engaging with the output shaft.

2. The cryogenic refrigerator as claimed in claim 1, wherein
- the rotation prevention mechanism comprises a plurality of engagement grooves formed in the displacer, and
- end portions of the engagement pin engage with the engagement grooves when the displacer rotates.

3. The cryogenic refrigerator as claimed in claim 1, wherein
- the rotation prevention mechanism comprises a plurality of standing pins standing on the displacer, and
- end portions of the engagement pin engage with the standing pins when the displacer rotates.

4. The cryogenic refrigerator as claimed in claim 3, wherein
- the standing pins are bolts, and
- the bolts have respective first end threaded portions mating with the displacer and have respective second end portions engaging with recesses formed in the lid body.

5. The cryogenic refrigerator as claimed in claim 1, wherein the engagement pin is a solid round bar.

* * * * *